US005983400A

United States Patent [19]

Kronenberger

[11] Patent Number: 5,983,400

[45] Date of Patent: Nov. 16, 1999

[54] HEADWEAR PIECE WITH IMPROVED ORNAMENTATION

[75] Inventor: Robert A. Kronenberger, Deerfield, Ill.

[73] Assignee: American Needle, Buffalo Grove, Ill.

[21] Appl. No.: 08/394,725

[22] Filed: Feb. 27, 1995

Related U.S. Application Data

[63] Continuation of application No. 07/984,467, Dec. 2, 1992, abandoned.

[51] Int. Cl.[6] ..... A41D 27/08; A42B 1/04

[52] U.S. Cl. ..... 2/209.13; 2/244; 2/918; D2/869

[58] Field of Search ..... 2/209.13, 209.12, 2/195.1, 918, 209.11, 175.1, 175.3, 244, 246; 446/27, 327, 901, 100; D2/869, 891, 895, 872

[56] References Cited

U.S. PATENT DOCUMENTS

| | | | |
|---|---|---|---|
| D. 162,965 | 4/1951 | Krieger | D2/869 |
| D. 188,029 | 5/1960 | Simon | D2/869 |
| 4,268,918 | 5/1981 | Lee | 2/199 |
| 5,111,366 | 5/1992 | Rife et al. | 2/209.13 X |
| 5,136,726 | 8/1992 | Kellin et al. | 2/115 X |
| 5,276,985 | 1/1994 | Halloran | 2/918 X |

*Primary Examiner*—Peter Nerbun

*Attorney, Agent, or Firm*—Wood, Phillips, VanSanten, Clark & Mortimer

[57] ABSTRACT

A headwear piece having a crown to receive the head of a wearer, with the crown having a front and rear, a top and bottom, and an external surface. A rim/bill is attached to the crown in depending fashion and has an external surface projecting angularly downwardly and away from the crown external surface. Ornamentation is provided to produce one of an advertisement, logo, scene and message and is attached to at least one of the crown and rim/bill so that a first part of the ornamentation overlies the crown and the second part of the ornamentation overlies the rim/bill. The first and second parts of the ornamentation cooperatively produce the one of the advertisement, logo, scene and message.

24 Claims, 2 Drawing Sheets

HEADWEAR PIECE WITH IMPROVED ORNAMENTATION

This is a continuation of application Ser. No. 07/984,467 filed Dec. 2, 1992, now abandoned.

BACKGROUND OF THE INVENTION

1. Field of the Invention

This invention relates to headwear of the type having a crown and an associated depending rim/bill and, more particularly, to a headwear piece with coordinated ornamentation on the crown and rim/bill that produces a unique visual effect.

2. Background Art

The baseball-style cap is one of the most widely used pieces of headwear and is worn by athletes and casual wearers alike. The baseball-style cap is comfortable, light in weight, and affords protection to the top of the wearer's head as well as shielding the wearer's face from sun and the elements through a forwardly projecting bill. The front wall of the crown of the baseball-style cap is widely used to display two-dimensional advertisements, logos, scenes, messages, etc.

Heretofore, advertisements, logos, scenes, messages, etc. have been placed on the baseball-style cap to be self-contained entirely on the crown. Consequently, the advertisement, logo, scene, message, etc. has simply a two-dimensional effect.

It is known to continue a pattern, as for example stripes, from a crown to a bill/rim, as disclosed in U.S. Pat. No. 4,222,125, or to color coordinate the crown and bill/rim, for purposes of aesthetics.

However, to the knowledge of the inventor herein, to date, no one has coordinated self-contained two-dimensional ornamentation on the crown and bill/rim of a headwear piece to produce advertisements, logos, scenes, messages, etc. that are partially on each of the crown and rim/bill.

SUMMARY OF THE INVENTION

The present invention has as its principal objective the provision of unique and aesthetically pleasing ornamentation on a headwear piece by coordinating the ornamentation on the crown and bill/rim of the headwear piece.

More particularly, a headwear piece is provided having a crown to receive the head of a wearer, with the crown having a front and rear, a top and bottom, and an external surface. A rim/bill is attached to the crown in depending fashion and has an external surface projecting angularly downwardly and away from the crown external surface. Ornamentation is provided to produce one of an advertisement, logo, scene and message and is attached to at least one of the crown and rim/bill so that a first part of the ornamentation overlies the crown and a second part of the ornamentation overlies the rim/bill. The first and second parts of the ornamentation cooperatively produce the one of the advertisement, logo, scene and message.

By reason of the curvature of the crown and rim/bill and the angular disposition of the rim/bill relative to the crown, a unique three dimensional visual effect is produced.

The ornamentation can be defined by thin sheets of material, embroidery, paint or dye, or a combination thereof.

In the case of thin sheets of materials, the material can be stitched onto the crown and/or rim/bill or alternatively can be attached thereto by an adhesive.

In one form, the first and second ornamentation parts are defined by a single sheet. In another form, the first and second parts are separable, each from the other to facilitate separate attachment to the bill/rim and crown. By joining the bill/rim and crown, the ornamentation parts are matched and united to complete the ornamentation.

In one form, the headwear piece is a baseball-style cap with a bill projecting forwardly from the crown. Preferably, the crown is made at least partially from a fabric that is flexible.

The invention further contemplates a headwear piece having a crown with a rim/bill associated therewith as previously described. Ornamentation is provided that defines one of a self-contained advertisement, logo, scene and message. The ornamentation is attached to the rim/bill and crown so that a first part of the one of the self-contained advertisement, logo, scene and message is on the crown and a second part thereof is on the rim/bill. The first and second parts of the one of the self-contained advertisement, logo, scene and message cooperatively produce the one of the self-contained advertisement, logo, scene and message. The second part of the one of the self-contained advertisement, logo, scene and message is angularly disposed relative to the first part of the one of the self-contained advertisement, logo, scene and message to produce a three dimensional visual effect.

In one form, the one of the advertisement, logo, scene and message is a letter and approximately one-half of the letter is on the crown with the other half of the letter on the rim/bill.

In a preferred form, at least one-third of the one of the advertisement, logo, scene and message is on each of the bill/rim and crown.

To add another dimension to the visual effect, at least one of the first and second parts of the one of the self-contained advertisement, logo, scene and message is distorted in such a manner that with the first and second parts matched and aligned in two dimensional relationship, the one of the self-contained advertisement, logo, scene and message is distorted. Distortion can occur on one or both of the first and second parts to give this unique effect.

DETAILED DESCRIPTION OF THE DRAWINGS

Figure 1:
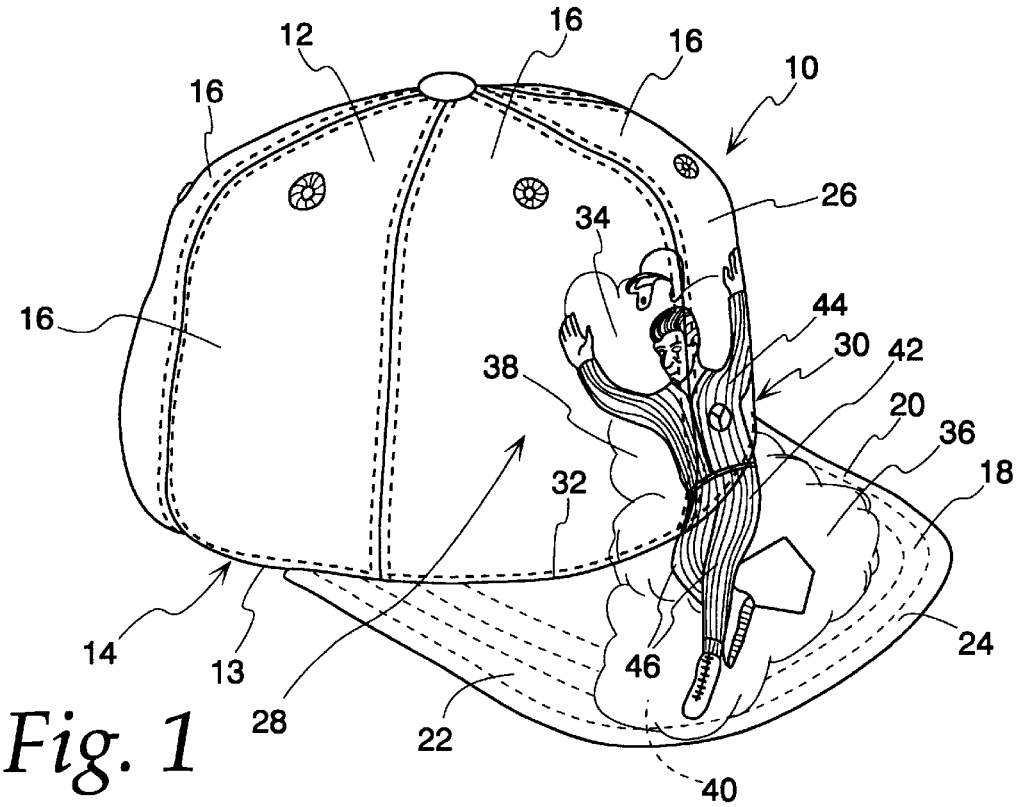
FIG. 1 is a perspective view of a baseball-style cap with ornamentation thereon according to the invention and in the form of a sheet that is attached to the headwear piece by adhesive.

In FIG. 1, one type of headwear piece, suitable for incorporation of the present invention, is shown at 10. The headwear piece 10 is a baseball-style cap and is disclosed merely to be representative of a headwear piece with which the present invention can be practiced. It should be understood that the present invention could be employed with other headwear styles as, for example, a headwear piece having a crown with a depending rim extending fully around the periphery thereof.

The headwear piece 10 consists of a crown 12 with a bottom edge defining an opening 14 to receive the head of a wearer. The crown 12 has a plurality of panels/gores 16 which are placed in edge-to-edge relationship and sewn to produce a continuous, inverted, cup-shaped configuration to accommodate the wearer's head. A bill/rim 18 projects forwardly from the crown 12 and serves to shield the face of the wearer from sun and the elements. The bill/rim 18 extends only part way around the bottom edge 13. The bill/rim 18 is bowed slightly to open in a downward direction. The bill/rim 18 is also inclined slightly downwardly from the back towards the front of the headwear piece 10. The curvature of the bill/rim 18 and its slight downward inclination tend to expose particularly the sides 20, 22 of the upper, external surface 24 of the bill/rim 18 both from the sides and the front of the headwear piece with the headwear piece 10 in place on a wearer's head.

The invention contemplates a unique ornamentation utilizing the angular relationship between the forwardly facing surface 26 on the front wall 28 of the crown and the surface 24 on the bill/rim 18. Typically, the first wall 18 of the crown and the surface 24 on the bill/rim 18 are at an angle with respect to each other of on the order of 90–110° for a conventional baseball cap.

The present invention is directed specifically to the ornamentation at 30 provided at the front of the headwear piece 10. The ornamentation 30 is an improvement over conventional ornamentation which is typically placed entirely on the front wall 28 of the crown 12 so as to give the viewer a simple two-dimensional effect. Typically, there will be a space between the line of juncture 32 between the crown 12 and bill/rim 18 to be certain that the entire ornamentation can be seen without obstruction by the bill/rim 18.

Contrary to this conventional practice, the present invention employs the bill/rim 18 to produce a three dimensional effect. The scene in FIG. 1 is exemplary of different ornamentation that can be placed on the headwear piece 10. For example, the ornamentation 30 might be an advertisement, logo, message, etc. However, regardless of the nature of the ornamentation 30, it is the objective of the present invention to place the ornamentation partially on the crown 12 and partially on the bill/rim 18 in such a manner that a first part 34 of the ornamentation 30 that is on the crown 12 and a second part 36 of the ornamentation 30 that is on the bill/rim 18 must be viewed cooperatively to perceive the entirety of the advertisement, logo, scene, message, etc. that makes up the ornamentation 30. The second part 36 of the ornamentation 30 is a unitary continuation of the first part of the ornamentation. This gives a unique, three-dimensional effect to the ornamentation.

In FIG. 1, the ornamentation parts 34, 36 are defined by a single sheet of material, typically a woven fabric. The ornamentation 30 is thus made as a self-contained patch 38 with, in this case, a baseball scene thereon. The patch 38 can then be attached to the forwardly facing surface 26 of the front wall 28 and the upper bill surface 24 as by an adhesive 40.

The scene on the ornamentation can be made so that it is undistorted with the patch 38 in a flattened state. Alternatively, the second part 36 of the ornamentation can be distorted to exploit the curvature, and angular orientation of the bill/rim 18 relative to the crown 12, to enhance the visual effect. For example, the lower body portion 42 of the player 44 could be angled so that the runner's legs 46 follow the curved surface 24 on the bill/rim 18 to give a more realistic three-dimensional appearance.

It is preferred that at least one-third of the ornamentation 30 be provided on each of the crown 12 and bill/rim 18 to maximize the effect of the invention. The objective is to have ornamentation 30 that is not self-contained on either of the crown 12 and bill/rim 18 but to provide ornamentation 30 that must be viewed on both the crown 12 and bill/rim 18 to comprehend the entirety of the advertisement, logo, scene and message.

Figure 2:
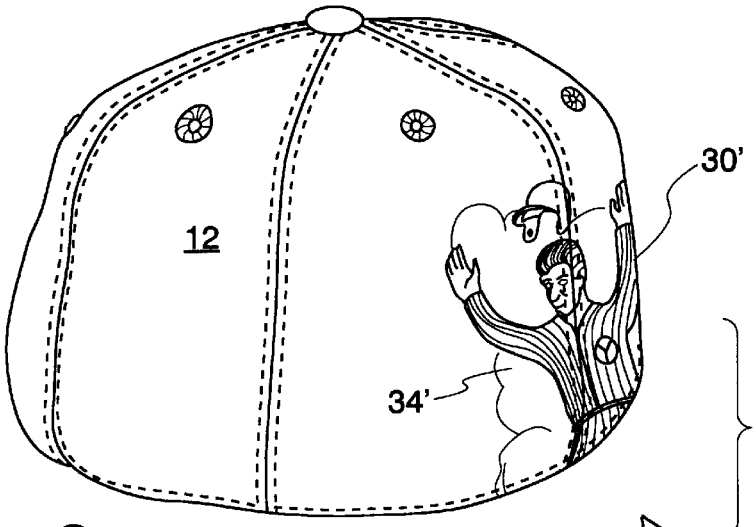
FIG. 2 is an exploded perspective view of a baseball-style cap with ornamentation thereon according to the present invention painted directly on the crown and bill.

In FIG. 2, a variation of the ornamentation 30 in FIG. 1 is shown at 30'. The principal difference between the ornamentation 30' and that 30 is that the ornamentation 30' is constructed so that the first and second parts thereof, 34', 36' are separately constructed and can be separately attached to the crown 12 and bill/rim 18 to facilitate manufacture. Once the bill/rim 18 is joined to the crown 12, the first and second parts 34', 36' are matched to complete the scene shown on the particular ornamentation 30' in FIG. 2.

In FIG. 2, the ornamentation parts 34', 36' are applied directly to the crown and bill/rim 18, as by a paint or dye. It should be understood that this two-part construction can be used with the overlying patch 38 by, for example, dividing the patch 38 along the juncture 32 between the crown 12 and bill/rim 18.

Figure 3:
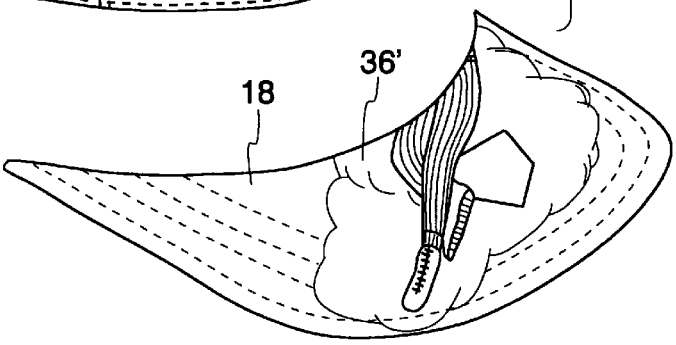
FIG. 3 is a fragmentary cross-sectional view of embroidery which can be used to define the ornamentation on the baseball-style cap.
Figure 3:
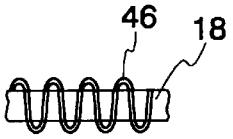

In FIG. 3, an alternative manner of applying the ornamentation 30, 30' is shown. In FIG. 3, the ornamentation 30, 30' is shown to be embroidered using thread 46 sewn directly into the bill 18. The crown 12 can be stitched in similar fashion.

Figure 4:
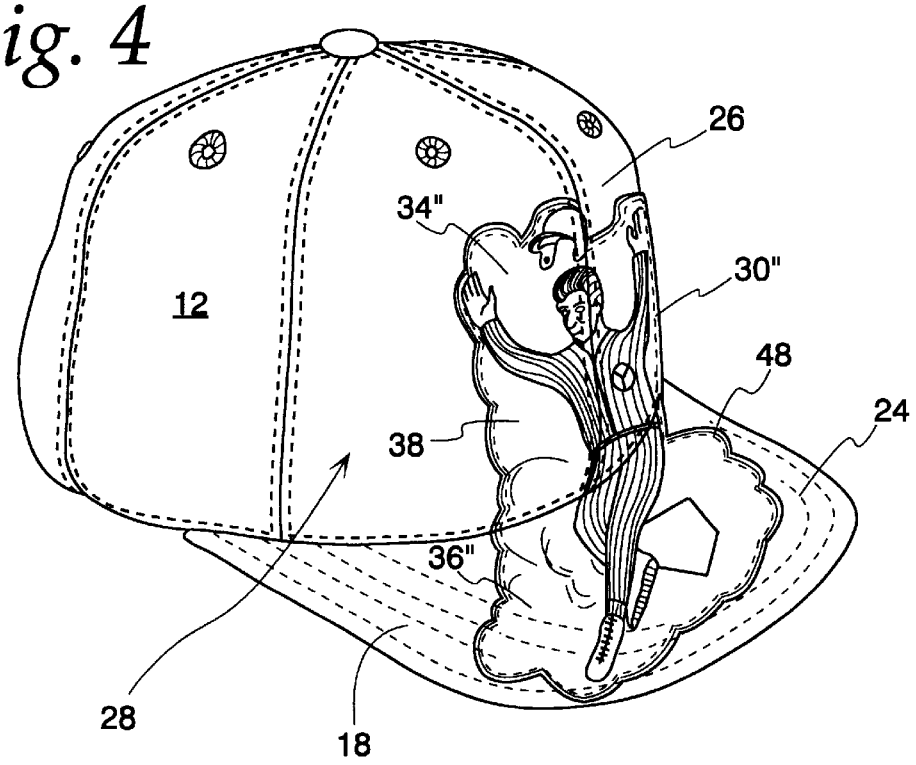
FIG. 4 is a perspective view of a baseball-style cap with ornamentation according to the present invention defined as a single sheet that is stitched to the crown and bill.

FIG. 4 shows a still further manner of applying ornamentation 30". In FIG. 4, the patch 38 is applied so as to overlie the forwardly facing surface 26 of the front wall 28 and the external bill/rim surface 24 in the same manner as the patch 38 in FIG. 1. The principal difference is that there is a line of stitching 48 that extends about the periphery of the patch 38 to attached the patch 38 to the crown 12 and bill/rim 18.

The ornamentation 30" can be made as a single piece or by using first and second cooperating parts 34", 36". Another significant aspect of this ornamentation 30" is that the angle between surfaces 24, 26 can be exploited to make the ornamentation more appealing. In this case, the baseball player 44 is shown in a slide stance, with the upper, vertically extending part of the player 44 being on the vertical crown surface 26. The horizontal portion of the ornamentation, i.e. the player's legs and home base into which the player is sliding, are on the horizontally extending bill/rim surface 24. This gives a more realistic depiction of a 3-dimensional scene. If this scene were flattened to 2-dimensions, it would be significantly distorted.

Figure 5:
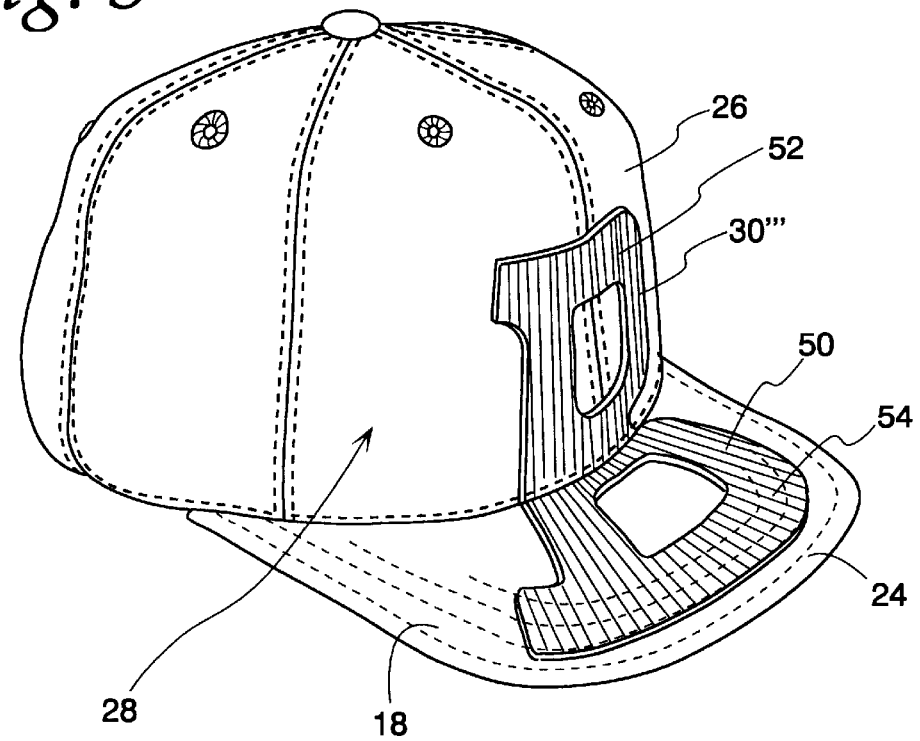
FIG. 5 is a perspective view of a baseball-style cap with ornamentation in the form of a letter/logo attached thereto according to the present invention.

A further variation of the ornamentation, according to the invention, is shown at 30'" in FIG. 5. The ornamentation 30'" consists of an exemplary letter 50 which is applied to the forwardly facing surface 26 of the front wall 18 and the external surface 24 of the bill/rim 18. The letter 50 is the letter "B" which has its top half 52 overlying the forwardly facing surface 26 and its bottom half 54 overlying the surface 24. The letter 50 can be applied as one piece or in separate parts through an adhesive, stitching, or it can be embroidered. In FIG. 5, the bottom half 54 of the letter "B" is somewhat larger and distorted to exaggerate the three-dimensional effect. Of course, the letter 50 could be normally constructed and still give a substantial three-dimensional effect.

It should be understood that the exact nature of the ornamentation can vary dramatically from what is shown. What is common to all of the ornamentation according to the invention is the diversion from a self-contained two-dimensional advertisement, logo, scene, message on one of the crown 12 and bill/rim 18 to the placement of parts of the potentially two-dimensional logo on each of the angularly oriented crown 12 and bill/rim 18 so that viewing of both the crown 12 and bill/18 is required to see the entire advertisement, logo, scene, message and realize a three-dimensional effect.

The foregoing disclosure of specific embodiments is intended to be illustrative of the broad concepts comprehended by the invention.

I claim:

1. A headwear piece comprising:

a crown to receive the head of a wearer, said crown having a front and rear, a top and bottom and an external surface, said crown further having a bottom edge defining an opening for the head of a wearer;

a rim/bill attached to the crown and having an external surface projecting angularly away from the crown external surface, said rim/bill extending only part way around the bottom edge of the crown;

ornamentation to produce one of a self-contained advertisement, logo, scene and message; and means for fixedly attaching the ornamentation to the external surface of each of the crown and rim/bill so that a first part of the ornamentation overlies and fully conforms to the crown and a second part of the ornamentation overlies and fully conforms to the rim/bill, the first and second parts of the ornamentation cooperating to produce the one of the advertisement, logo, scene, and message, said second part of the ornamentation being a unitary continuation of the first part of the ornamentation and angularly disposed relative to the first part of the ornamentation to produce a three-dimensional visual effect, the first and second parts not projecting significantly outwardly from the external surfaces to which the first and second parts attach so that the first and second parts do not significantly alter the overall shape of the external surfaces to which they attach.

2. The headwear piece according to claim 1 wherein the first and second ornamentation parts are each defined by a thin sheet of material.

3. The headwear piece according to claim 1 wherein the attaching means comprises stitching.

4. The headwear piece according to claim 1 wherein the first and second ornamentation parts are separate, each from the other.

5. The headwear piece according to claim 1 wherein at least one of the first and second ornamentation parts comprises embroidery.

6. The headwear piece according to claim 2 wherein the first and second ornamentation parts are defined by a single sheet of material.

7. The headwear piece according to claim 1 wherein the headwear piece is a baseball-style cap with a bill projecting forwardly from the crown.

8. The headwear piece according to claim 7 wherein the crown is made at least partially from fabric.

9. A headwear piece comprising:

a crown to receive the head of a wearer, said crown having a front and rear, a top and bottom and an external surface, said crown further having a bottom edge defining an opening for the head of a wearer;

a rim/bill attached to the crown and having an external surface projecting angularly away from the crown external surface, said rim/bill extending only part way around the bottom edge of the crown;

ornamentation that defines one of a self-contained advertisement, logo, scene, and message; and means for attaching the ornamentation to the rim/bill and crown so that a first part of the one of the self-contained advertisement, logo, scene, and message follows the contour of the external surface of the crown and a second part of the one of the self-contained advertisement, logo, scene, and message follows the contour of the external surface of the rim/bill, neither of said first and second parts of the one of the self-contained advertisement, logo, scene, and message projecting significantly outwardly from the external surface to which it attaches so that the ornamentation does not significantly alter the overall shape of the external surfaces of the crown and rim/bill, said first and second parts of the one of the self-contained advertisement, logo, scene, and message cooperatively producing the one of the self-contained advertisement, logo, scene and message;

said second part of the one of the self-contained advertisement, logo, scene, and message being a unitary continuation of the first part of the self-contained advertisement, logo, scene, and message and angularly disposed relative to the first part of the one of the self-contained advertisement, logo, scene, and message to produce a three dimensional visual effect.

10. The headwear piece according to claim 9 wherein the one of the advertisement, logo, scene, and message comprises a letter and approximately one-half of the letter comprises said first part of the letter and approximately the other half of the letter comprises the second part of the letter.

11. The headwear piece according to claim 9 wherein at least one third of the one of the advertisement, logo, scene, and message is on each of the bill/rim and crown.

12. The headwear piece according to claim 9 wherein the first and second parts of the self-contained advertisement, logo, scene and message can be placed in a) a first state wherein the first and second parts of the self-contained advertisement, logo, scene and message are flattened to a two-dimensional state and b) a second state wherein the first part of the self-contained advertisement, logo, scene and message following the contour of the external surface of the crown and the second part of the second self-contained advertisement, logo, scene and message follows the contour of the external surface of the rim/bill, said first and second parts of the self-contained advertisement, logo, scene and message cooperatively producing one of a self-contained advertisement, logo, scene and message that is distorted with the first and second parts of the self-contained advertisement, logo, scene and message in the first state.

13. The headwear piece according to claim 12 wherein the first and second ornamentation parts are each defined by a thin sheet of material.

14. The headwear piece according to claim 9 wherein the attaching means comprises stitching.

15. The headwear piece according to claim 9 wherein the first and second ornamentation parts are separate, each from the other.

16. The headwear piece according to claim 9 wherein at least one of the first and second ornamentation parts comprises embroidery.

17. The headwear piece according to claim 9 wherein the first and second ornamentation parts are defined by a single sheet of material.

18. The headwear piece according to claim 9 wherein the headwear piece is a baseball-style cap with a bill projecting forwardly from the crown.

19. The headwear piece according to claim 9 wherein the crown is made at least partially from fabric.

20. The headwear piece according to claim 9 wherein the attaching means comprises an adhesive.

21. The headwear piece according to claim 1 wherein the ornamentation is a depiction of a 3-dimensional logo/scene which in 3-dimensions has a vertically extending component and a horizontally extending component and the vertically extending component is at least partially on the external surface of the crown and the horizontally extending component is at least partially on the external surface of the rim/bill.

22. The headwear piece according to claim 1 wherein the external surface of the rim/bill extends substantially horizontally and the external surface of the crown extends substantially vertically.

23. The headwear piece according to claim 1 wherein there is a substantial angle between the external surface of the rim/bill and the external surface of the crown.

24. The headwear piece according to claim 23 wherein the angle between the external surface of the rim/bill and the external surface of the crown is on the order of 90–110°.

* * * * *